US006453878B1

(12) United States Patent
Mazet

(10) Patent No.: US 6,453,878 B1
(45) Date of Patent: Sep. 24, 2002

(54) ELECTRICALLY CONTROLLED FUEL SUPPLY PUMP FOR INTERNAL COMBUSTION ENGINE

(75) Inventor: Henri Mazet, Chatou (FR)

(73) Assignee: Magneti Marelli France, Nanterre (FR)

( * ) Notice: Subject to any disclaimer, the term of this patent is extended or adjusted under 35 U.S.C. 154(b) by 0 days.

(21) Appl. No.: 09/743,601

(22) PCT Filed: Jul. 9, 1999

(86) PCT No.: PCT/FR99/01689

§ 371 (c)(1),
(2), (4) Date: Jan. 11, 2001

(87) PCT Pub. No.: WO00/03135

PCT Pub. Date: Jan. 20, 2000

(30) Foreign Application Priority Data

Jul. 13, 1998 (FR) ..... 98 08992

(51) Int. Cl.[7] ..... F02M 37/04
(52) U.S. Cl. ..... 123/497; 123/511
(58) Field of Search ..... 123/497, 357, 123/350, 511, 514, 457, 458

(56) References Cited

U.S. PATENT DOCUMENTS 4,756,291 A * 7/1988 Cummins et al. ..... 123/497
5,379,741 A * 1/1995 Matysiewicz et al. ..... 123/497
5,398,655 A 3/1995 Tuckey
5,483,940 A * 1/1996 Namba et al. ..... 123/497
5,715,797 A 2/1998 Yamaguchi et al.
5,762,046 A 6/1998 Holmes et al.
5,775,304 A * 7/1998 Kono et al. ..... 123/497

FOREIGN PATENT DOCUMENTS

| | | |
|---|---|---|
| DE | 40 19 083 | 12/1991 |
| EP | 0 264 556 | 8/1987 |
| EP | 0 577 477 | 6/1993 |
| FR | 2 686 947 | 1/1993 |
| FR | 2 725 244 | 10/1994 |
| GB | 2 313 930 | 12/1997 |
| WO | WO 98 27333 | 6/1998 |

* cited by examiner

*Primary Examiner*—Willis R. Wolfe
*Assistant Examiner*—Mahmoud Gimie
(74) *Attorney, Agent, or Firm*—Henderson & Sturm LLP

(57) ABSTRACT

The invention concerns a pump with an electric motor pumping fule in a fuel tank and supplying a ramp of injectors aided by a fuel pressure regulator. The pump motor is controlled by a control unit for adjusting the pump output pressure, evaluated by a relationship between said pressure and at least a mean current of the pump motor, at an objective pressure level determined by the control unit and selected higher than the operating pressure of the regulator, such as a pressure-reducing valve, and whereof the pressure characteristic is known to the control unit. The invention is useful for supplying fuel to direct or indirect injection engines in motor vehicles.

7 Claims, 2 Drawing Sheets

ELECTRICALLY CONTROLLED FUEL SUPPLY PUMP FOR INTERNAL COMBUSTION ENGINE

CROSS-REFERENCE TO RELATED APPLICATIONS

This application is the national phase of International Application No. PCT)FR99/01689 filed Jul. 9, 1999, which claims priority of French Patent Application No. FR 98 08992 filed Jul. 13, 1998 which are incorporated herein by reference in their entirety.

BACKGROUND OF THE INVENTION

1. Field of the Invention

The invention relates to the fuel supply circuits of internal combustion engines for automobile vehicles, and more particularly to the fuel supply circuits of spark-ignition or compression-ignition (diesel) internal combustion engines equipped with direct or indirect fuel injection systems and including a fuel pump driven by an electric motor.

2. Description of the Prior Art

A fuel supply circuit of an injection system for an internal combustion engine conventionally includes a pump driven by an electric motor and taking fuel from a tank in order to pump it to an injector supply manifold via a supply pipe incorporating a fuel filter. A pressure regulator downstream of the manifold maintains an injector supply pressure in the manifold which is a differential pressure between the pressure of the fuel and either atmospheric pressure or the pressure in the air inlet manifold of the engine, which differential pressure is substantially constant, regardless of the fuel demand of the engine, i.e. regardless of the flowrate at which fuel is injected into the engine by the injectors, according to the operating conditions of the engine. The pressure regulator returns excess fuel to the tank via a return pipe.

In high-pressure injector systems for spark-ignition or diesel engines the pump does not supply the injector manifold directly, but instead supplies a high-pressure second pump and a high-pressure second regulator, which in turn supply the manifold.

The conventional circuit referred to above has the disadvantages of requiring a permanent and high fuel flowrate at the outlet of the pump, and thus a non-negligible power consumption, and of producing a high level of noise from the pump, and leads to significant heating of the fuel returned to the tank after passing through the manifold and the pressure regulator, which produces large amounts of fuel vapor.

A fuel supply circuit of the above kind is disclosed in EP-A-577 477, for example, in which a differential pressure sensor is also incorporated into the regulator and takes the form of a manometric sensor of the diaphragm type which cuts off the supply of fuel to the injectors if the fuel pressure is below a predetermined threshold.

To reduce the heating of the fuel, and therefore the emission of fuel vapor accumulating in the tank, it has been proposed to mount the pressure regulator upstream of the injector supply manifold, between the inlet of the manifold and a filter downstream of the pump, and preferably near or in the tank, on a branch pipe discharging into the tank and connected to the supply pipe between the filter and the inlet of the manifold. In this case, the pressure regulator also returns excess fuel to the tank.

A circuit of the above kind is not entirely satisfactory because it also requires a high and permanent flowrate of fuel at the pump outlet, leading to a high electric power consumption and a high level of noise, and because the pump operates continuously at a high rotation speed, resulting in the need to use pumps having a long service life, which are therefore costly.

To overcome these drawbacks "no return" supply circuits, i.e. circuits with no fuel return pipe or pressure regulator on a branch connection, have been proposed. In "no return" supply circuits the electrical power supply of the pump is controlled by a sensor responsive to the pressure in the supply pipe connecting the pump to the injector supply manifold. The electrical power supplied to the pump is controlled by a module which is controlled by the pressure sensor and takes the form of an electronic control unit imposing a pump outlet pressure that is equal to the pressure required at the injectors.

Circuits of the above kind have the advantages of reducing the quantity of fuel passing through the pump and the filter, and therefore of reducing the heating of the fuel, and reducing the power consumption and noise level of the pump. However, they are not totally satisfactory because they require pressure sensors which are costly, because of the measurement accuracy required, and do not always achieve satisfactory pressure regulation.

For the above reasons, more economic implementations have been proposed, in particular in EP-A-264 556, in which a fuel pressure regulator on the pipe through which the pump supplies the injectors includes a diaphragm separating two chambers in a casing. One of the chambers is at atmospheric pressure and contains a spring whose spring force can be adjusted by an adjuster screw and which spring-loads the diaphragm, which carries one of two electrical contacts of a manometric sensor, toward the other electrical contact of the sensor, which is accommodated in the other chamber, through which fuel flowing from the pump to the engine passes. If the pressure of the fuel coming from the pump applies sufficient force to the diaphragm to overcome the force of the spring, the electrical contact between the two terminals of the manometric sensor incorporated in the pressure regulator is broken and this cuts off the supply of electrical power to the pump motor. This reduces the fuel pressure at the pump outlet, and therefore in the fuel chamber of the device, as a result of which the spring moves the diaphragm until the two contacts of the manometric sensor touch, which reconnects the electrical power supply to the pump motor. The power supply current of the motor is therefore pulse width modulated as a function of the pump outlet pressure, the fuel demand of the engine and the adjustable force exerted by the spring of the manometric sensor.

Improved variants of fuel supply circuits of the above type have been proposed, in particular in U.S. Pat. No. 5,398,655 and FR-A-2 725 244, which dispense with a manometric sensor in the fuel pressure regulator and in or near the tank with a pressure inlet connected to the supply pipe, said regulator supplying the injector manifold immediately upstream of the manifold in order to deliver to the manifold a pressure that is not disturbed by any pressure pulses in the supply pipe between the pump and the manifold and in order to benefit from the inlet manifold air pressure reference.

In the aforementioned two patents, the pressure regulator includes a diaphragm exposed on one side to the force exerted by a calibration spring and either to atmospheric pressure or the air pressure in the inlet manifold and on the other side to the pressure of the fuel supplied to the manifold and entering the regulator via an inlet valve whose closure member, which is optionally spring-loaded, is rigidly connected to the diaphragm to move with it. A regulator of the above kind provides a constant differential injector supply pressure regardless of the fuel demand of the engine in a "no return" fuel supply circuit.

In FR-A-2 725 244, the manometric sensor includes a diaphragm exposed on one side to the pressure of the fuel at the pump outlet and on the other side to the force exerted by a spring, and the diaphragm moves a mobile contact relative to a fixed contact of a control switch of an electronic module controlling the supply of electrical power to the pump drive motor. The manometric sensor is set to a pressure higher than the pressure required at the regulator outlet. Because only the fuel that is actually used passes through the pump, the power consumption of the pump motor remains low compared to prior art systems including a branch from the supply pipe.

In U.S. Pat. No. 5,398,655, the pressure sensor at the pump outlet is a threshold sensible manometric sensor and is associated with a relief valve. When it detects a fuel pressure at the pump outlet higher than a threshold which is itself higher than the nominal fuel pressure, the sensor commands a pulse width modulator which modulates the power supply current of the pump electric motor. The sensor also opens the relief valve in order to return to the tank the fuel at the high pressure in the supply pipe between a check valve at the pump outlet and the inlet of the pressure regulator of the constant differential pressure manifold.

FR-A-2 686 947 discloses a circuit for distributing fuel to an engine in accordance with engine demand in which the speed of the pump is regulated to transmit fuel under pressure from the tank to the engine at a flowrate which varies as a function of the electrical power supplied to the pump by an electronic circuit controlled by a sensor detecting the quantity of air admitted to the engine. The pump therefore operates at a speed which is just sufficient to satisfy the engine demand, pumping noise is reduced at low pump speeds and low engine speeds, and the pump draws less current at engine idling speeds.

In all the "no return" circuits of the patents previously cited, the electric pump is controlled either in a closed loop, on the basis of a measured operating parameter of the supply circuit, usually the fuel pressure at the pump outlet, or on the basis of the measured air flowrate at the engine air inlet manifold, which is indirectly related to the flowrate of the fuel consumed by the engine. In all cases, the installation must therefore include at least one sensor of that operating parameter for sending a control signal to an electronic unit modulating the electrical power supplied to the pump drive motor.

BRIEF SUMMARY OF THE INVENTION

One object of the invention is to propose a fuel supply circuit including a controlled-pressure electric pump which retains all the advantages of the "no return" circuits described hereinabove without the drawback of requiring at least one dedicated sensor on the air and fuel circuits of the engine for controlling the pump.

Another object of the invention is to propose a fuel supply circuit which advantageously and simultaneously also has the advantages of prior art fuel supply circuits in which the pump is in a fuel reserve bowl in the fuel tank and to which some of the fuel pumped by the pump is diverted in the form of at least one jet of fuel injected into the bowl at a flowrate necessary to prevent the pump de-priming.

To this end, a fuel supply circuit in accordance with the invention for an internal combustion engine, including a fuel pump driven by an electric motor, pumping fuel stored in a fuel tank and supplying directly or indirectly a manifold supplying at least one fuel injector, with the assistance of at least one fuel pressure regulator, is characterized in that the motor of the pump is controlled by an electronic control unit which aligns the output pressure of the pump to a target pressure determined by the electronic control unit and greater than the operating pressure of the pressure regulator, which is of the pressure regulator/pressure reducing valve type, and whose pressure characteristic is known to the electronic control unit, the output pressure of the pump being determined by the electronic control unit on the basis of a relationship between the output pressure and at least the average current of the motor of the pump.

Thus the pressure is no longer controlled by a feedback loop with the aid of a fuel pressure sensor at the inlet of the manifold or in the supply pipe, but the fuel pressure, in a supply circuit which is otherwise substantially identical to a conventional "no return" circuit, is instead controlled toward the manifold by the pressure regulator/pressure reducing valve, which is of conventional prior art construction, and upstream of the pressure regulator/pressure reducing valve by the electronic control unit which controls the pump to obtain the appropriate output pressure, which is higher than the operating pressure of the pressure regulator/pressure reducing valve. This is achieved by aligning the actual pump outlet pressure, as measured by the electronic control unit on the basis of at least the average pump motor current, to a target pressure calculated or generated by the control unit to satisfy the criterion whereby the pressure must be greater than the operating pressure of the pressure regulator/pressure reducing valve.

The electronic control unit advantageously controls the average current of the motor by calculating an error signal between a target average current corresponding to the target pressure and the average current of the motor as measured by said unit.

The relationship between the output pressure of the pump and at least the average current of the motor advantageously also takes into account at least the rotation speed of the pump and/or the thermal state of the pump, to be more precise the thermal state of its pumping stage, and/or the flowrate of the pump.

This technical feature enables the pressure of the pump to be controlled in the manner specified and also allowing in particular for the fuel flowrate required by the engine.

To this end the flowrate of the pump is determined taking into account at least the flowrate of the internal combustion engine, as calculated by an electronic engine control unit controlling at least the injection of fuel into the engine and associated with the electronic control unit, to which the electronic engine control unit transmits at least an indication of the flowrate required by the engine.

If the pump is in a fuel reserve bowl in the fuel tank and a fraction of the fuel pumped by the pump is diverted to the bowl, into which the fraction of the fuel is injected with a jet flowrate needed to prevent the pump de-priming, the flowrate of the pump is advantageously determined allowing also for the necessary flowrate of the jet.

The rotation speed of the pump can be determined by analyzing the instantaneous motor current and detecting commutation of the collector of the motor.

A simple way to detect commutation of the collector of the motor is to filter the instantaneous motor current in at least one high-pass filter.

In a circuit according to the invention the fuel pressure regulator/pressure reducing valve is advantageously disposed immediately upstream of the manifold and defines the fuel pressure therein on the basis of the higher fuel pressure that it receives from the pump.

BRIEF DESCRIPTION OF THE SEVERAL VIEWS OF THE DRAWINGS

Other advantages and features of the invention will emerge from the description of one embodiment of the invention given below, by way of non-limiting example, and with reference to the accompanying drawings, in which.

DETAILED DESCRIPTION OF THE INVENTION

Figure 1:
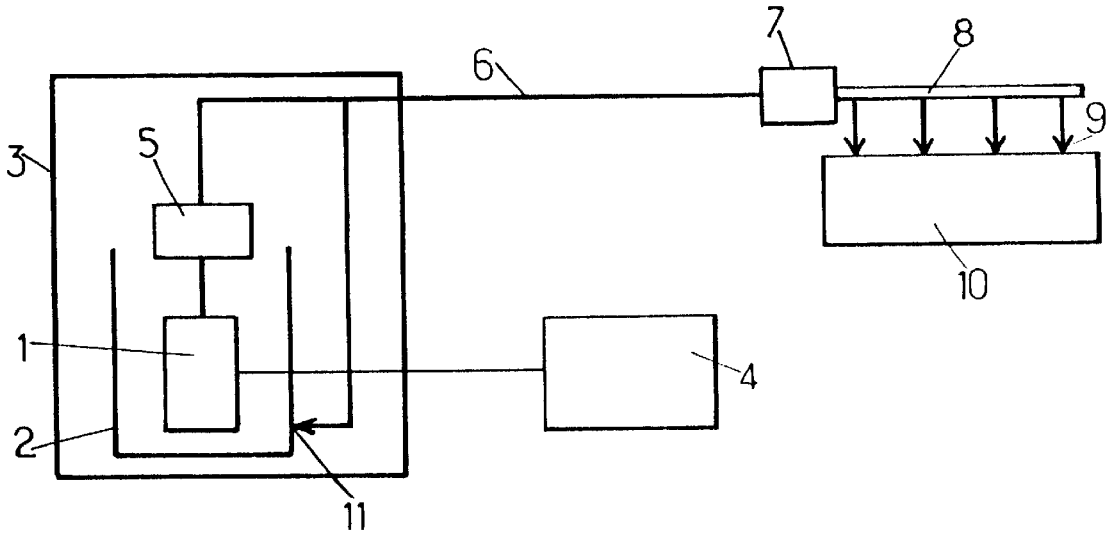
FIG. 1 is a diagrammatic view of the fuel supply circuit of a fuel-injected engine.

The fuel supply circuit shown in FIG. 1 includes an electric fuel pump 1 which includes, in a manner that is well-known in the art, a pump stage driven in rotation by an electric motor, preferably a motor of the type fed with electrical current via the commutation of a motor collector.

The electric pump 1 is in a fuel reserve bowl 2 on the bottom of a fuel tank 3.

The electric motor of the pump 1 is supplied with electrical current by an electronic control unit 4. The pump 1 draws in fuel from the reserve bowl 2, preferably via an upstream filter (not shown), and pumps the fuel through a downstream filter 5 in a supply pipe 6 toward a fuel pressure regulator 7.

The regulator 7 supplies fuel to a manifold 8 at the downstream end of the supply pipe 6. The manifold is a common supply manifold of fuel injectors 9 of an internal combustion engine 10. Upstream of the regulator 7, a fraction of the fuel pumped by the pump 1 in the supply pipe 6 is returned to the bowl 2 in the form of a jet 11 injected into the base of the bowl 2 with a minimum flowrate needed to prevent the pump 1 de-priming.

If the engine 10 is an indirect-injection spark-ignition engine, the regulator 7 supplies the manifold 8 directly with fuel at a working pressure suitable for supplying the injectors 9 with a substantially constant differential pressure between the fuel pressure and the air pressure in the engine inlet manifold.

If the engine 10 is a direct-injection spark-ignition or compression-ignition engine, the regulator 7 feeds the manifold indirectly, via a high-pressure pump associated with a high-pressure regulator which determines the pressure at which fuel is injected by the injectors 9.

In both cases the pressure regulator 7 is a regulator/pressure reducing valve of a type well-known in the art, for example of the type with a diaphragm and inlet valve, as described in U.S. Pat. No. 5,398,655 and in FR-A-2 725 244, and which defines the fuel pressure in the manifold 8, or toward the inlet of the high-pressure pump, on the basis of a higher fuel pressure that it receives from the pump 1, so that it can deliver fuel to the downstream manifold 8 at a satisfactory pressure, regardless of the fuel demand of the engine 10.

A pressure regulator/pressure reducing valve 7 of the above kind has the advantage of simple and economic construction, requiring only a relatively low accuracy in respect of the pressure that it receives.

The filter 5 and the fuel branch connection to the jet 11 can take the form of a sub-assembly near or in the tank 3, in which the sub-assembly can be directly associated with the pump 1.

The control unit 4 controls the pump 1 so that its real outlet pressure is as far as possible aligned to a target pressure higher than the operating pressure of the pressure regulator/pressure reducing valve 7, which operating pressure is slaved to the pressure in the air inlet manifold of the engine 10. The pressure characteristic of the pressure regulator 7 is known to the unit 4 and the target pressure is chosen so that the flowrate of the pump simultaneously satisfies the demand of the engine 10, at any engine operating point, and the requirement for a minimum flowrate of the return jet 11 into the reserve bowl 2 to prevent the pump 1 de-priming.

Figure 3:
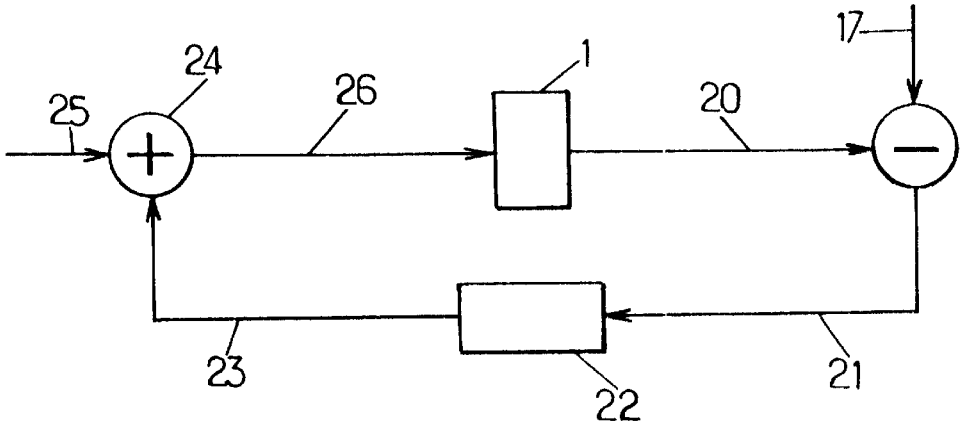
FIGS. 2 and 3 are diagrams of the control provided by the electronic control unit of the circuit shown in FIG. 1 for slaving the outlet pressure of the electric pump of the circuit to a target pressure.
Figure 2:
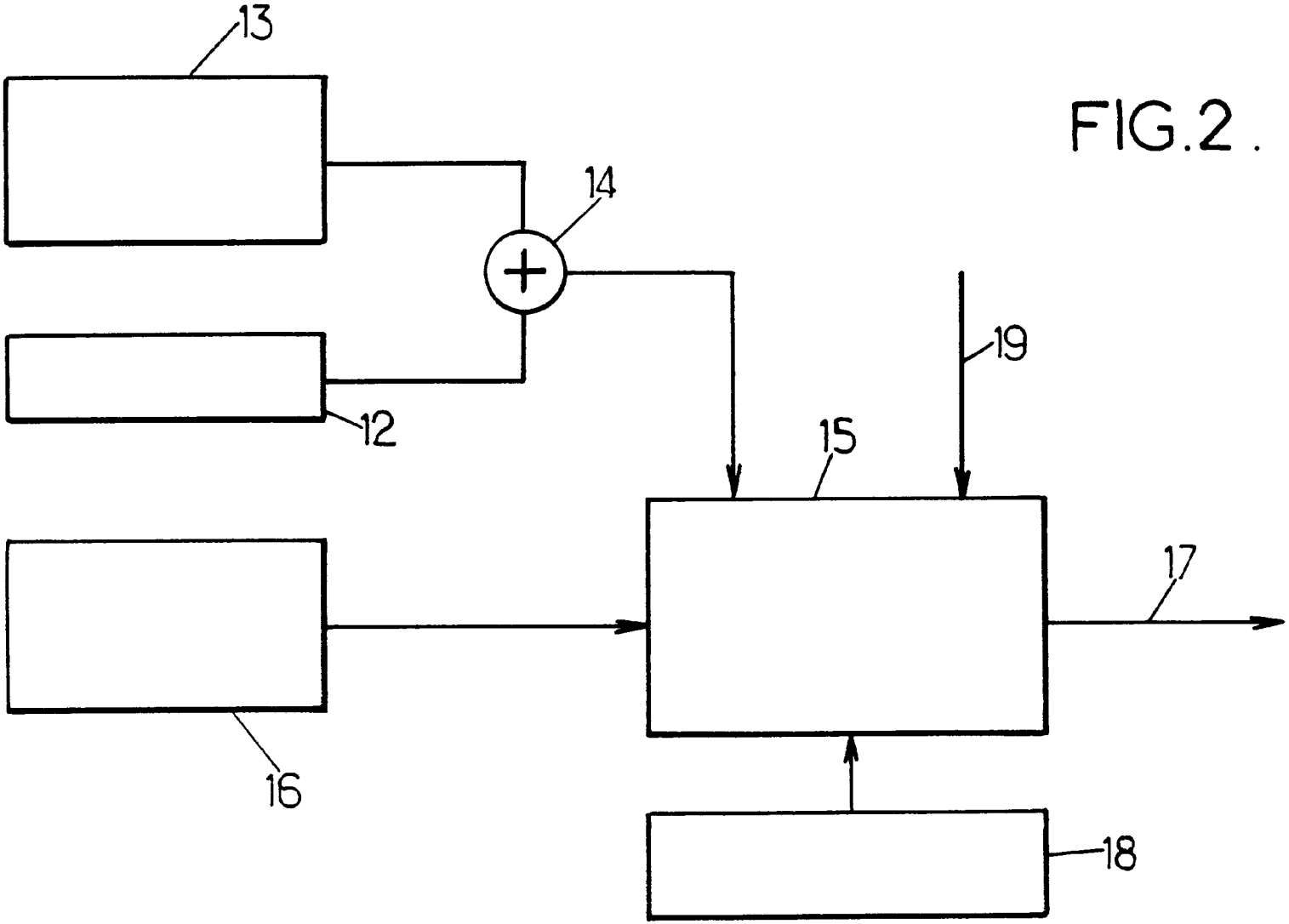

The real outlet pressure of the pump 1 is aligned to the target pressure by a control circuit in the control unit 4 shown diagrammatically in FIGS. 2 and 3.

Referring to FIG. 2, the unit 4 receives an engine flowrate indication 12 supplied by an electronic engine control unit of any appropriate type known in the art and which controls fuel injection and therefore knows, for each operating engine point, the times and durations of injection of fuel by the injectors 9 into the cylinders of the engine 10. If the engine 10 is a spark-ignition engine, the engine control unit (not shown) advantageously also controls ignition and possibly other functions, such as skidding prevention, or the admission of air in the case of a motor-driven butterfly valve body.

The electronic control unit 4 of the circuit in accordance with the invention is therefore associated with the engine control unit and is advantageously at least partly integrated into it, with the possible exception of its power stage, through which relatively high currents flow.

Like the engine control unit, the control unit 4 is an electronic unit including in particular computing means based on microprocessors or microcontrollers and memory means, in particular in the form of maps of values and curves in the control unit 4 characteristic of operating parameters of the engine and the fuel supply circuit, in particular the characteristic relating the average current of the motor of the pump 1 to the outlet pressure of the pump 1.

The control unit 4 stores in its memory 13 the characteristic relating the flowrate of the jet 11 to the pressure in the pipe 6 and the unit 4 calculates the sum 14 of the engine flowrate 12 and the jet flowrate 13, which constitutes a pump flowrate to be complied with and is taken into account in a unit 15 implementing a functional model of the pump 1.

In parallel with this the unit 4 generates a target pressure signal 16, which is transmitted to the modeling unit 15, on the basis of operating conditions of the engine 10, for example the conditions that apply on starting the engine 10, which are transmitted to the unit 4 by the engine control unit, and on the basis of the pressure characteristic of the pressure regulator/pressure reducing valve 7, which is a design feature and is stored in memory in the unit 4. The modeling unit 15 also includes programs implementing algorithms, maps stored in the unit 4 to generate a signal 17 representing the target average current for the motor of the pump 1, which corresponds to the target pressure 16 of the pump, allowing for other operating parameters of the pump 1, and in particular the temperature 18 of the pump 1, to be more precise the temperature of its pumping stage, which is taken into account together with the rotation speed 19 of the pump 1. The rotation speed is measured by the unit 4, for example by analyzing the instantaneous current in the motor of the pump 1 and detecting commutation of the collector of the motor. In a manner that has been used in the laboratory, and is now applied in the unit 4 by the invention, commutation of the collector of the electric motor of the pump 1 is detected by filtering the instantaneous current of the electric motor in at least one high-pass filter.

The signal 17 representing the target average current of the motor of the pump 1 is therefore available at the output of the pump modeling unit 15, in which it is determined from the target pressure 16, allowing for the rotation speed 19 of the pump 1 and the temperature 18 of the pumping stage of the pump 1 in the average current-pressure relationship, which is essentially determined from a map in the unit 15. The unit 4 uses the average current signal 17 to control the average current of the motor of the pump 1 to achieve the required alignment of the actual pump outlet pressure to the target pressure.

This average current control is shown diagrammatically in FIG. 3.

In FIG. 3, the unit 4 calculates the difference between the target average current 17 and the real average current 20 of the motor of the pump 1, which is measured in the unit 4 by measuring a voltage drop across a shunt, in a manner that is known in the art. The error signal 21 resulting from this difference between the target average current 17 and the instantaneous current 20 is transmitted to a unit 22, in which it is subjected to proportional, integral and derivative processing by appropriate algorithms, in a manner that is known in the art. The unit 22 outputs a differential control signal 23 which is added by an adder 24 to a nominal control current 25 of the electric motor of the pump 1. For example, the control current comprises voltage pulses of variable width (or variable duty factor), and the nominal control current 25 is converted into an actual control current 26 of the same type (i.e. with variable width current pulses) which is delivered by the unit 4 to the electric motor of the pump 1 in order to align the measured average current 20 to the target average current 17 and thereby align the real output pressure of the pump 1 to the target pressure 16 determined by the control unit 4.

What is claimed is:

1. A fuel supply circuit for an internal combustion engine, including a fuel pump driven by an electric motor, pumping fuel stored in a fuel tank and supplying a fuel manifold supplying at least one fuel injector, with the assistance of at least one fuel pressure regulator, having a pressure characteristic which is known to an electronic control unit controlling said pump motor for aligning a pump output pressure to a target pressure determined by said electronic control unit on the basis of a relationship between said pump output pressure and at least an average current fed to said pump motor;

wherein said fuel pressure regulator is of a pressure regulator/pressure reducing valve type disposed immediately upstream of said fuel manifold and has an operating pressure defining a fuel pressure,in said fuel manifold which is deprived of any fuel return pipe returning to said fuel tank, and said target pressure is determined by said electronic control unit so as to be greater than said pressure regulator operating pressure.

2. A fuel supply circuit according to claim 1, wherein said electronic control unit controls said average current of said pump motor by calculating an error signal between a target average current corresponding to said target pressure and said average current of said pump motor measured by said electronic control unit.

3. A fuel supply circuit according to either claim 1 or claim 2, wherein said relationship between said pump output pressure and at least said motor average current also takes into account at least one of operating parameters including a pump rotation speed, a pump flowrate, and a thermal state of a pump pumping stage.

4. A fuel supply circuit according to claim 3, wherein said pump rotation speed is determined by analyzing a pump rotor instantaneous current and detecting commutation of a collector of said pump motor.

5. A fuel supply circuit according to claim 4, wherein commutation of said pump motor collector is detected by filtering said pump motor instantaneous current in at least one high-pass filter.

6. A fuel supply circuit according to claim 3, wherein said pump flowrate is determined taking into account at least a flowrate of said internal combustion engine, calculated by an electronic engine control unit controlling at least injection of fuel into said engine and associated with said electronic control unit, to which said electronic engine control unit transmits an indication of said flowrate required by said engine.

7. A fuel supply circuit according to claim 6, wherein said pump is in a fuel reserve bowl in said fuel tank and a fraction of fuel pumped by said pump is diverted to said bowl into which said fraction of fuel is injected with a jet flowrate needed to prevent said pump de-priming, said pump flowrate being determined allowing also for said necessary jet flowrate.

* * * * *